US008302218B2

(12) United States Patent
Dignitti et al.

(10) Patent No.: US 8,302,218 B2
(45) Date of Patent: Nov. 6, 2012

(54) RECONFIGURABLE TUB ASSEMBLY

(75) Inventors: Daniel Dignitti, Hamburg, NY (US); John L. Jones, Jr., East Aurora, NY (US); Juliette Welch, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 547 days.

(21) Appl. No.: 12/259,866

(22) Filed: Oct. 28, 2008

(65) Prior Publication Data

US 2010/0101011 A1 Apr. 29, 2010

(51) Int. Cl.
*A47K 3/024* (2006.01)
*A47K 3/02* (2006.01)

(52) U.S. Cl. ..... 4/572.1; 4/586; 4/589; 4/621; 4/659

(58) Field of Classification Search ..... 4/571.1, 4/572, 1, 573.1, 574.1, 575.1, 577.1, 578.1, 4/579, 580, 583, 584, 585, 586, 589, 590, 4/621, 659, 661, DIG. 18, 514; D6/382; D23/277, 278, 279, 280.1
See application file for complete search history.

(56) References Cited

U.S. PATENT DOCUMENTS

| | | | | | |
|---|---|---|---|---|---|
| 668,322 | A | * | 2/1901 | Stephen | 4/514 |
| 1,271,384 | A | * | 7/1918 | Stroll | 4/579 |
| 1,512,068 | A | * | 10/1924 | Thornburg | 4/572.1 |
| 2,109,089 | A | * | 2/1938 | Moyes | 4/514 |
| 2,531,724 | A | | 11/1950 | Cevasco | |
| 2,545,733 | A | * | 3/1951 | Hatfield | 220/574.2 |
| 2,548,301 | A | * | 4/1951 | Gibson | 4/553 |
| 2,876,459 | A | * | 3/1959 | Ackerson | 4/572.1 |
| D188,838 | S | * | 9/1960 | Johnson, Jr. | D23/278 |
| 3,031,229 | A | * | 4/1962 | Symbaluk | 297/467 |
| D200,414 | S | | 2/1965 | Karp | |
| 3,248,741 | A | | 5/1966 | Stout et al. | |
| D220,103 | S | | 3/1971 | Clowe | |
| 3,633,222 | A | | 1/1972 | Greenfield | |
| 3,965,496 | A | * | 6/1976 | Grelle | 4/517 |
| D241,250 | S | * | 8/1976 | Fotre et al. | D23/278 |
| 3,995,331 | A | | 12/1976 | Fotre et al. | |
| D251,303 | S | | 3/1979 | Boissonneault | |
| 4,197,838 | A | * | 4/1980 | Shill | 601/157 |
| D260,281 | S | | 8/1981 | Rist | |
| 4,327,452 | A | * | 5/1982 | Swatzell | 4/523 |
| 4,333,188 | A | * | 6/1982 | Jensen et al. | 4/514 |
| 4,521,926 | A | * | 6/1985 | Kuether | 4/579 |
| D299,741 | S | * | 2/1989 | Thom | D23/278 |
| 4,881,281 | A | | 11/1989 | Lavoine et al. | |

(Continued)

FOREIGN PATENT DOCUMENTS

EP 2133015 A1 * 12/2009

(Continued)

*Primary Examiner* — Basil Katcheves
*Assistant Examiner* — Rodney Mintz
(74) *Attorney, Agent, or Firm* — Edell, Shapiro & Finnan, LLC

(57) ABSTRACT

The present invention relates to a tub for bathing infants or children. The tub includes a receptacle for containing water and for receiving an infant. The tub also includes a selectively removable insert or positioning member that can be used to change the bathing area inside of the tub. When the positioning member is locked to the tub, the positioning member defines two separate infant seating positions within the tub. The positioning member is removable from the tub to allow the entire receptacle to be used.

22 Claims, 14 Drawing Sheets

U.S. PATENT DOCUMENTS

| | | | | | |
|---|---|---|---|---|---|
| 4,974,267 | A | * | 12/1990 | Sheu | 4/572.1 |
| 5,033,131 | A | * | 7/1991 | Paden | 4/572.1 |
| D326,314 | S | * | 5/1992 | Purrier et al. | D23/278 |
| 5,181,284 | A | | 1/1993 | Raphael et al. | |
| 5,249,316 | A | * | 10/1993 | Macchiavello | 4/559 |
| 5,276,926 | A | | 1/1994 | Lopez | |
| D345,632 | S | * | 3/1994 | McLaughlin | D30/158 |
| 5,361,430 | A | * | 11/1994 | Wise | 4/572.1 |
| 5,423,095 | A | * | 6/1995 | Bearer | 4/514 |
| D367,521 | S | | 2/1996 | Miller | |
| 5,588,159 | A | | 12/1996 | Poulson et al. | |
| D400,655 | S | | 11/1998 | Thompson | |
| 5,829,070 | A | | 11/1998 | Taylor | |
| 5,937,461 | A | * | 8/1999 | Dombrowski et al. | 5/655 |
| 6,067,670 | A | * | 5/2000 | Eddy et al. | 4/575.1 |
| D430,737 | S | * | 9/2000 | Nowak et al. | D6/333 |
| D438,604 | S | * | 3/2001 | Harrison et al. | D23/280.4 |
| 6,205,953 | B1 | * | 3/2001 | Ginn | 119/165 |
| 6,243,890 | B1 | | 6/2001 | Yang | |
| 6,272,698 | B1 | * | 8/2001 | Stafford | 4/555 |
| RE37,481 | E | | 12/2001 | Crossley et al. | |
| 6,415,460 | B1 | * | 7/2002 | Rossman et al. | 4/572.1 |
| 6,463,598 | B1 | * | 10/2002 | David et al. | 4/591 |
| 6,507,959 | B1 | | 1/2003 | Sundberg et al. | |
| D469,860 | S | | 2/2003 | Riemer et al. | |
| 6,578,209 | B2 | | 6/2003 | Lopes et al. | |
| 6,785,917 | B1 | * | 9/2004 | Bryant | 4/572.1 |
| 7,032,259 | B1 | | 4/2006 | Kilion | |
| 7,055,187 | B1 | * | 6/2006 | Fields | 4/560.1 |
| 7,065,805 | B1 | * | 6/2006 | Sundberg | 4/572.1 |
| 7,302,715 | B1 | | 12/2007 | Finell | |
| 7,430,769 | B2 | * | 10/2008 | Davis | 4/572.1 |
| D608,102 | S | * | 1/2010 | Kemm | D6/361 |
| D612,023 | S | * | 3/2010 | Harris | D23/278 |
| 7,721,362 | B2 | * | 5/2010 | Martin et al. | 4/514 |
| 7,814,584 | B2 | * | 10/2010 | Robles et al. | 4/545 |
| D630,478 | S | * | 1/2011 | Bell | D7/698 |
| 7,886,375 | B2 | * | 2/2011 | Thorne et al. | 4/572.1 |
| 8,151,382 | B1 | * | 4/2012 | Kennedy | 4/571.1 |
| 2002/0002739 | A1 | * | 1/2002 | Demonet | 4/559 |
| 2002/0066139 | A1 | * | 6/2002 | David et al. | 4/591 |
| 2003/0103140 | A1 | * | 6/2003 | Watkins | 348/148 |
| 2004/0221383 | A1 | * | 11/2004 | Sieger et al. | 4/584 |
| 2006/0143819 | A1 | | 7/2006 | Davis | |
| 2007/0136942 | A1 | * | 6/2007 | Metaxas | 4/572.1 |
| 2007/0220669 | A1 | | 9/2007 | Monti et al. | |
| 2007/0261164 | A1 | * | 11/2007 | Martin et al. | 4/654 |
| 2008/0295239 | A1 | * | 12/2008 | Ristuccia et al. | 4/589 |
| 2009/0013460 | A1 | * | 1/2009 | Whitley | 4/540 |
| 2009/0049596 | A1 | * | 2/2009 | Ferris | 4/514 |
| 2009/0158521 | A1 | * | 6/2009 | Richardson et al. | 4/572.1 |
| 2010/0071124 | A1 | * | 3/2010 | Ammirato | 4/573.1 |
| 2010/0320821 | A1 | * | 12/2010 | Trapp et al. | 297/274 |
| 2011/0083261 | A1 | * | 4/2011 | Goergen | 4/572.1 |

FOREIGN PATENT DOCUMENTS

| | | | | |
|---|---|---|---|---|
| EP | 2286702 | A2 | * | 2/2011 |
| GB | 2053673 | A | | 2/1981 |
| GB | 2135185 | A | | 8/1984 |
| JP | 06253994 | A | * | 9/1994 |
| JP | 08089430 | A | * | 4/1996 |
| JP | 8103390 | | | 4/1996 |
| JP | 10328063 | A | * | 12/1998 |
| JP | 2002143015 | A | * | 5/2002 |
| JP | 2008036036 | A | * | 2/2008 |
| WO | 9502983 | | | 2/1995 |
| WO | 03103467 | A1 | | 12/2003 |

* cited by examiner

RECONFIGURABLE TUB ASSEMBLY

FIELD OF THE INVENTION

The present invention relates to an infant tub or tub assembly that is reconfigurable. In particular, the present invention relates to an infant tub and an insert that can be coupled to and removed from the infant tub as desired. The infant tub can be reconfigured between one configuration in which the tub has one large receptacle in which an infant can be placed and another configuration in which the tub has two receptacles.

BACKGROUND OF THE INVENTION

Parents and caregivers often use a tub to bathe infants and/or toddlers. Conventional tubs typically include an area defined by a wall that extends around a bottom or bottom portion. Uncoordinated and or young infants seated in a tub can easily slide along a tub bottom and slide out of the position in which they are placed in the tub.

The ends (such as a front end and a back end) of some tubs can be used as backrests for an infant or toddler disposed in the tub. The front end of the tub can be inclined from the bottom of the tub at a different angle with respect to the bottom than the back end of the tub. The different backrest angles of inclination allow a child to be positioned in two different sitting positions in the tub. In one position, the child's back rests on the inclined front end. In another position, the child's back rests on the inclined back end.

As an infant grows, the area needed for bathing the infant changes as well. A shorter infant needs less of the receptacle than a taller infant. Accordingly, as an infant grows, the portion of the receptacle of the tub that is used increases.

Therefore, there is a need for a tub that can be easily reconfigured to accommodate different sizes of infants. In addition, there is a need for a tub that can be easily reconfigured to support infants in different positions.

SUMMARY OF THE INVENTION

The present invention relates to an infant tub or tub assembly that can be used to bathe an infant or child. In one embodiment, the infant tub can be reconfigured to accommodate different sized infants or children. In another embodiment, the infant tub can be reconfigured to support an infant or child therein in different positions, such as an inclined position and an upright position.

In order to more securely position an infant within the tub or change the configuration of the receptacle, the tub includes a body and a removable support member or insert that can be coupled to the body of the tub. In one embodiment, the tub body includes two ends or end portions, two sides or side portions, and a bottom or bottom portion. The ends of the tub body can be referred as a front end portion or member and a back end portion or member, depending on the orientation of the tub body. The ends include surfaces that can be used as backrests for an infant disposed in the tub and extend from the bottom portion at different angles relative to the bottom portion to provide backrests at different angles of inclination.

In one embodiment, the support member generally extends between the sides of the tub body and along the bottom of the tub body. An infant can sit against the support member and the support member supports the infant in a comfortable sitting position. In addition, the support member, along with the tub body generally, prevents the child from moving out of a sitting position. When the support member is coupled to the tub body, two receptacles are formed and the child can be securely placed in two different sitting positions. Each seating position is formed by an inclined backrest and the side of the support member closest to the backrest. The sides of the support member can have different shapes or configurations to create a comfortable engagement surface and form a seat with its corresponding backrest.

In one embodiment, the tub also includes a positioning member or insert that is removably coupleable to the tub. The insert can be disposed in an engagement position that is located proximate to a middle portion of the tub. In one embodiment, the insert is made of a molded material that retains its shape and allows the insert to be securely coupled to the tub body. In another embodiment, the insert is formed from a flexible material that can be deformed to facilitate the decoupling of the insert from the tub body.

In one embodiment, the insert includes opposite ends with a coupling portion proximate to each of the ends. The tub body can include a mounting portion on each of the side walls or portions and/or on the bottom portion of the tub body. The coupling portions of the insert lockably engage corresponding mounting portions of the tub body to couple the insert to the tub body.

In different embodiments, the insert can be coupled to the tub body in different manners. In one embodiment, the tub body can be formed of a material that has some flexibility that allows a first portion of the tub body to be moved relative to a second portion of the tub body. The insert can be coupled to the first portion of the tub body and to the second portion of the tub body. When the first portion and the second portion of the tub body are moved away from each other, the insert is decoupled from the tub body. The first portion can be a side wall or portion and the second portion can be the opposite side wall or portion.

In another embodiment, the shape or configuration of the positioning member or insert can change to allow the insert to be coupled to and decoupled from the tub body. In this embodiment, the insert can be changed from a rest configuration to a deformed configuration. To couple the insert to the tub body, the insert is deformed and then placed into a lockable position. When the insert is in its lockable position, the insert is released and flexes back to its unbiased shape. In the unbiased shape, the coupling portions on the insert fully and lockably engage mounting portions on the tub body.

Connecting the insert to the tub body can occur using different methods. In one method, the insert is deformed by a parent squeezing the insert before placing the insert in a lockable position inside the tub body. In another method, portions (e.g., coupling portions) of an un-deformed insert can become deformed as the insert is forced onto the tub's mounting portion. Either method results in the placement of each coupling portion of the insert being aligned with one of the mounting portions of the tub. Disengagement of the insert from the tub involves movement of a portion of either or both the tub body and the insert. In one embodiment, a parent can change the configuration of the tub body, thereby allowing the insert to disengage from the tub body. In another embodiment, a parent can change the configuration of the insert, thereby allowing the insert to disengage from the tub body.

BRIEF DESCRIPTION OF THE DRAWINGS

Like reference numerals have been used to identify like elements throughout this disclosure.

DETAILED DESCRIPTION OF THE INVENTION

The terms "child," "toddler," and "infant" may be used interchangeably herein. In addition, the terms "receptacle," "recess," "cavity," "receiving area," and "receiving portion" may be used interchangeably to refer to the area defined by the tub body in which an infant can be placed. The terms "insert," "insert member," "positioning member," and "support member" may be used interchangeably herein to refer to the member that is selectively coupleable to a tub body to reconfigure the receiving area of the tub and provide support for an infant disposed therein. In addition, the terms "mounting structure" and "mounting portion" may be used interchangeably herein. As described below, the tub body and insert can be referred to collectively as a tub assembly.

While the discussion of the present invention is primarily with respect to a tub that can be used by an infant or child, the concept of a removable insert for a tub in accordance with the present invention is applicable to tubs or bathing structures that can be used by toddlers, older children, and/or adults.

In one embodiment, the present invention relates to a tub for bathing a child. The tub includes a tub body with a recess within which the child can be placed. The tub body can be reconfigured between a first configuration for smaller infants and a second configuration for larger infants. The different configurations can also be used to support or prop-up an infant in the tub in different positions. Reconfiguring the tub between configurations allows the tub to be used as the size of the infant changes and the infant is disposed in different positions.

Figure 1:
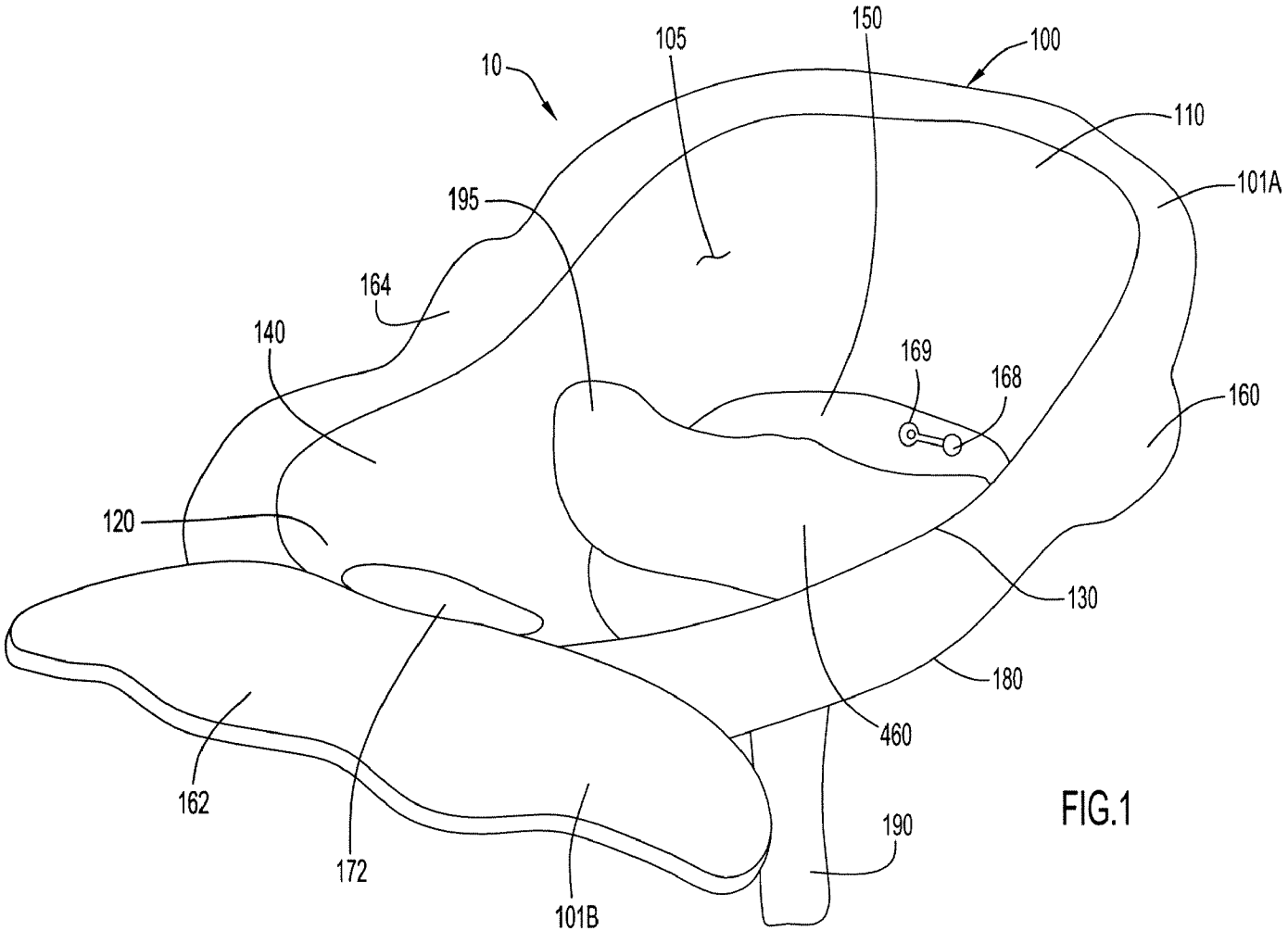
FIG. 1 illustrates a top perspective view of an embodiment of a tub or tub assembly according to the present invention.

Referring to FIG. 1, an embodiment of a tub or tub assembly according to the present invention is illustrated. In this embodiment, the tub 10 is a molded plastic object that is configured to be used to bathe an infant or child. Tub 10 includes a tub body 100 that is configured to define recess or receptacle 105. The body 100 includes a backrest 110 at one end or end portion 101A, a backrest 120 at an opposite end or end portion 101B, and two side portions 130 and 140 between the backrests 110 and 120. The side portions 130 and 140 can be referred to alternatively as side wall portions. The backrests 110 and 120 and the side portions 130 and 140 collectively form a wall that extends around the body 100. The tub body 100 also includes a bottom or bottom surface 150. In this embodiment, along the upper edges of the surrounding walls is a tub rim 180.

In one embodiment, the tub 10 is configured to resemble the shape of a whale. However, in different embodiments, the tub 10 can have any shape or configuration. As shown in FIG. 1, the tub body 100 includes portions 160 and 164 that resemble fins of a whale. Each of the portions 160 and 164 is integrally formed with the rim 180 proximate on side portions 130 and 140, respectively. A tail 162 is also formed with rim 180 near the end of the tub proximate to backrest 120. In this embodiment, backrest 120 includes a pad 172 removably or fixedly coupled thereto increase the comfort of a child placed in contact with second backrest 120. The body 100 also includes a drain 168 with a closure mechanism 169 that can be removably inserted into the drain 168. The body 100 may include several legs (only one leg 190 shown in FIG. 1) that are configured to support the body 100 on a support surface.

As shown in FIG. 1, the tub 10 includes an insert or positioning member 195 that can be engaged with the tub body 100. The insert can be referred to as an insert member as well. As described below, the insert 195 can be coupled to and removed from the tub body 100 as desired. When the insert 195 is coupled to the tub body 100 in the position shown in FIG. 1, an infant disposed in the tub 10 can contact or engage the insert 195. When an infant is placed proximate to backrest 110, the insert 195 is configured to prop up or otherwise maintain the infant in a seated or more upright orientation. Similarly, when an infant is placed proximate to backrest 120, the insert 195 can be used to maintain the infant in a seated or upright orientation. Removal of insert 195 results in the full receptacle 105 being available for the infant in the tub 10.

Figure 2:
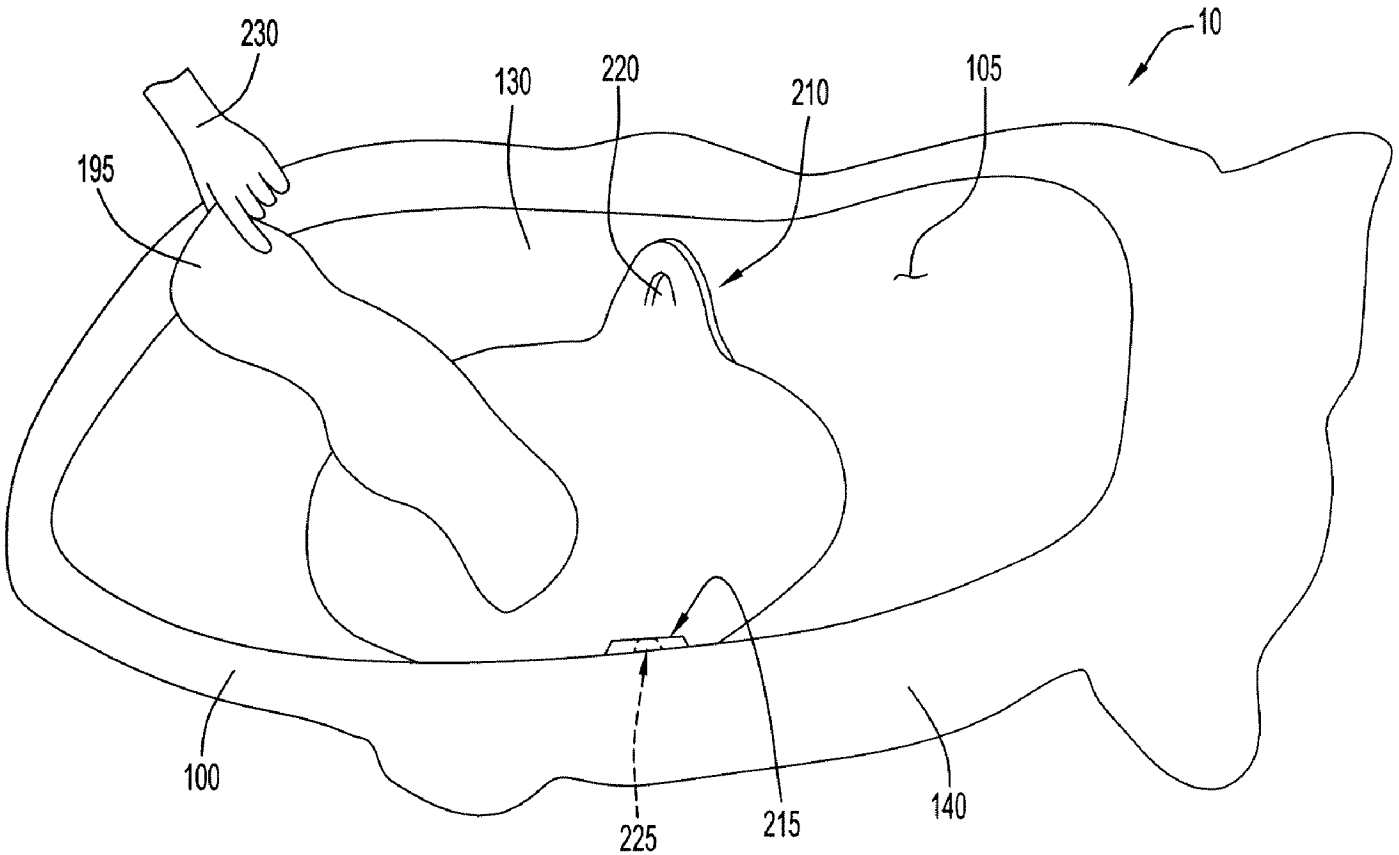
FIG. 2 illustrates a top perspective view of the tub illustrated in FIG. 1 showing the support member being removed from the tub.

FIG. 2 illustrates the insert 195 being removed by a parent 230 from its locked engagement position in the tub recess 105 defined by body 100 of the tub 10. As shown in FIG. 2, the tub body 100 includes mounting structures or portions 210 and 215 opposite to each other. In this embodiment, the mounting structures or portions 210 and 215 are formed in side walls 130 and 140, respectively. As shown, mounting structure or portion 210 is formed on the inner side of side portion 130 proximate to the bottom or bottom surface 150. Similarly, mounting structure or portion 215 is formed on the inner side of side portion 140 proximate to the bottom or bottom surface 150. Mounting portion 210 includes a recess or receptacle 220 formed therein, the function of which is described in detail below. Mounting portion 215 includes a corresponding recess 225 (shown in dashed lines).

Figure 3:
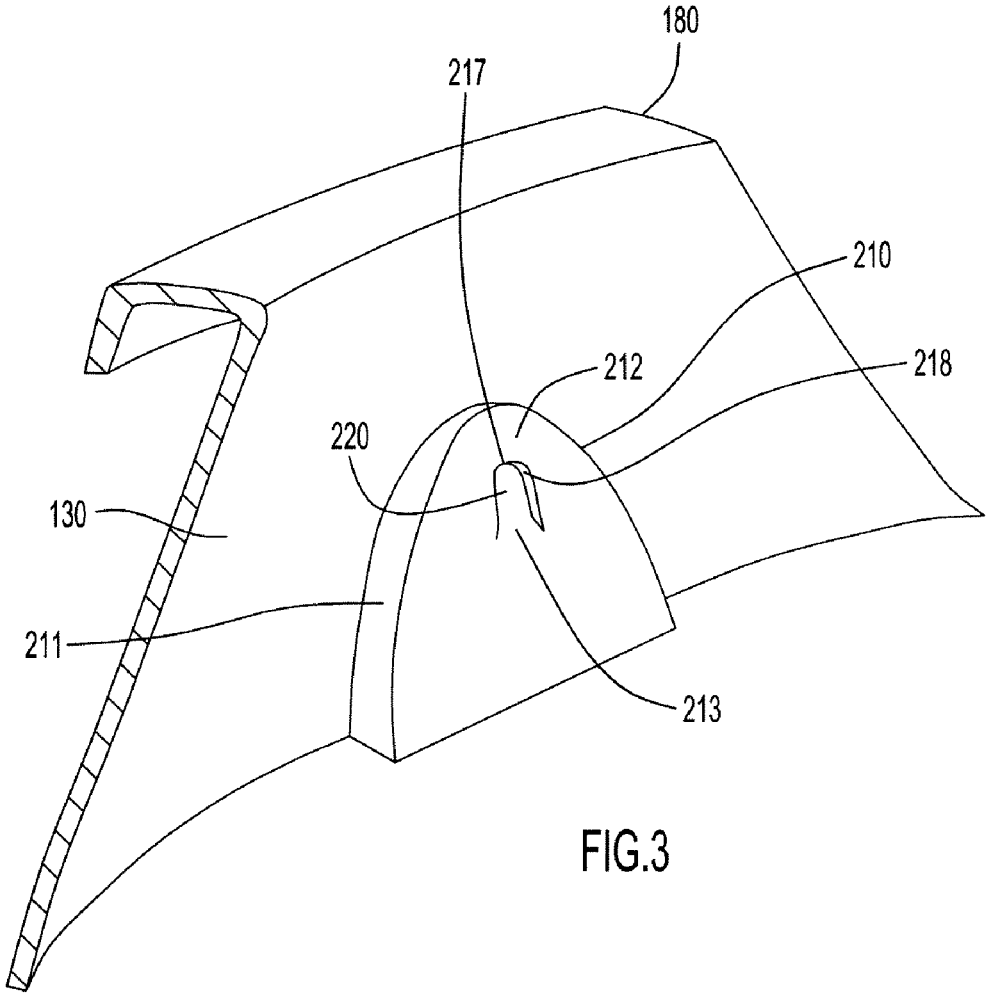
FIG. 3 illustrates a close-up perspective view of a portion of the tub illustrated in FIG. 1.

Referring to FIG. 3, a partial cross-sectional view of a portion of the tub body 100, and in particular, side portion 130, is illustrated. In this embodiment, the side portion 130 includes a rim 180 at its upper end. The side portion 130 includes mounting portion 210 which has a mounting structure or surface 211 and an inclined contact surface 212. The mounting portion 210 includes a recess 220 formed therein that is configured to be engaged by part of the insert 195 to couple the insert 195 to the tub body 100. The recess 220 extends from a lower end 213 to an upper end 217 and varies in depth. Proximate to end 217 is a wall 218 that defines the upper limit of the recess 200. The function of the wall 218 is described in detail below. Although not shown in FIG. 3, mounting portion 215 includes a similar mounting structure or surface, inclined surface, and recess.

Figure 4:
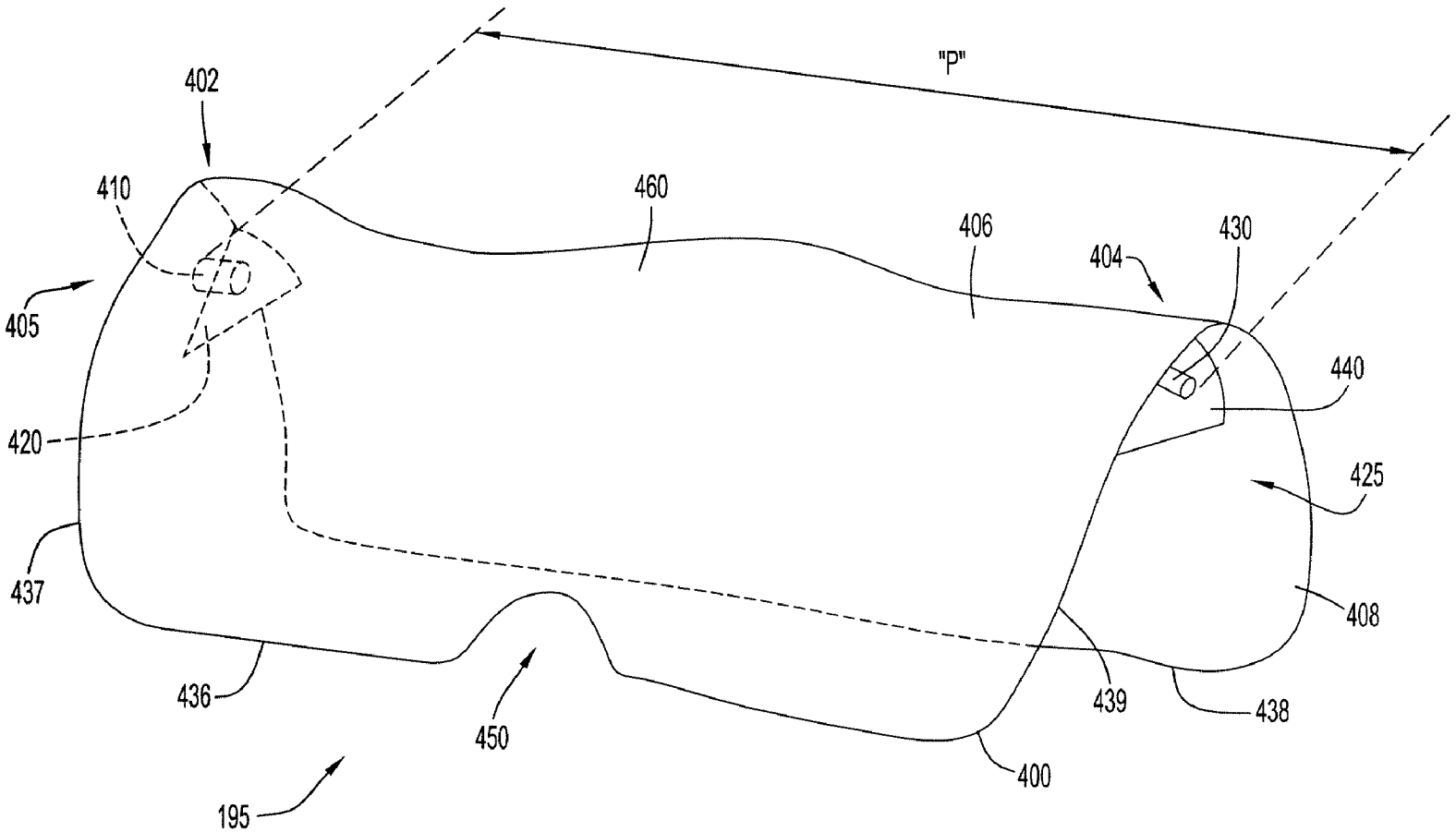
FIG. 4 illustrates a perspective view of an embodiment of a support member according to the present invention.

Referring to FIG. 4, an embodiment of an insert or positioning member according to the present invention is illustrated. In this embodiment, the insert 195 is molded plastic and includes a body 400 with ends 402 and 404 and an engaging portion 460 (shown in FIGS. 1 and 4) that extends between the ends 402 and 404. The engaging portion 460 is configured to be engaged by an infant in the receptacle 105. The engaging portion 460 of the body 400 has an outer surface 406 and an inner surface 408. While body 400 has a generally inverted U shape along its length, in different embodiments, the cross-sectional configuration of the body 400 may vary.

Proximate to ends 402 and 404 are coupling portions or coupling mechanisms 405 and 425, respectively. Coupling portion 405 includes a projection 410 that is coupled to a projection support 420. Similarly, coupling portion 425 includes a projection 430 that is coupled to a projection support 440. In one embodiment, projection 410 is integrally formed with projection support 420 and projection 430 is integrally formed with projection support 440. Referring to FIG. 4, the distance between the distal ends or tips of projections 410 and 430 is shown by the dimension "P."

Projection supports 420 and 440 are connected to the inner or lower side 408 of body 400. The projection supports 420 and 440 are configured so that projections 410 and 430 are supported from and extend away toward the opposite ends of insert 195. As shown in FIG. 4, the body 400 includes lower side edges 436 and 438 and opposite end edges 437 and 439. Each of the edges 436, 437, 438, and 439 is configured to engage a surface of the tub body 100. In one embodiment, the body 100 includes a notch or recess 450 formed along edge 436. The notch 450 is configured to be engaged by a user to grasp the insert 195 as well as to allow water to flow therethrough.

Figure 5:
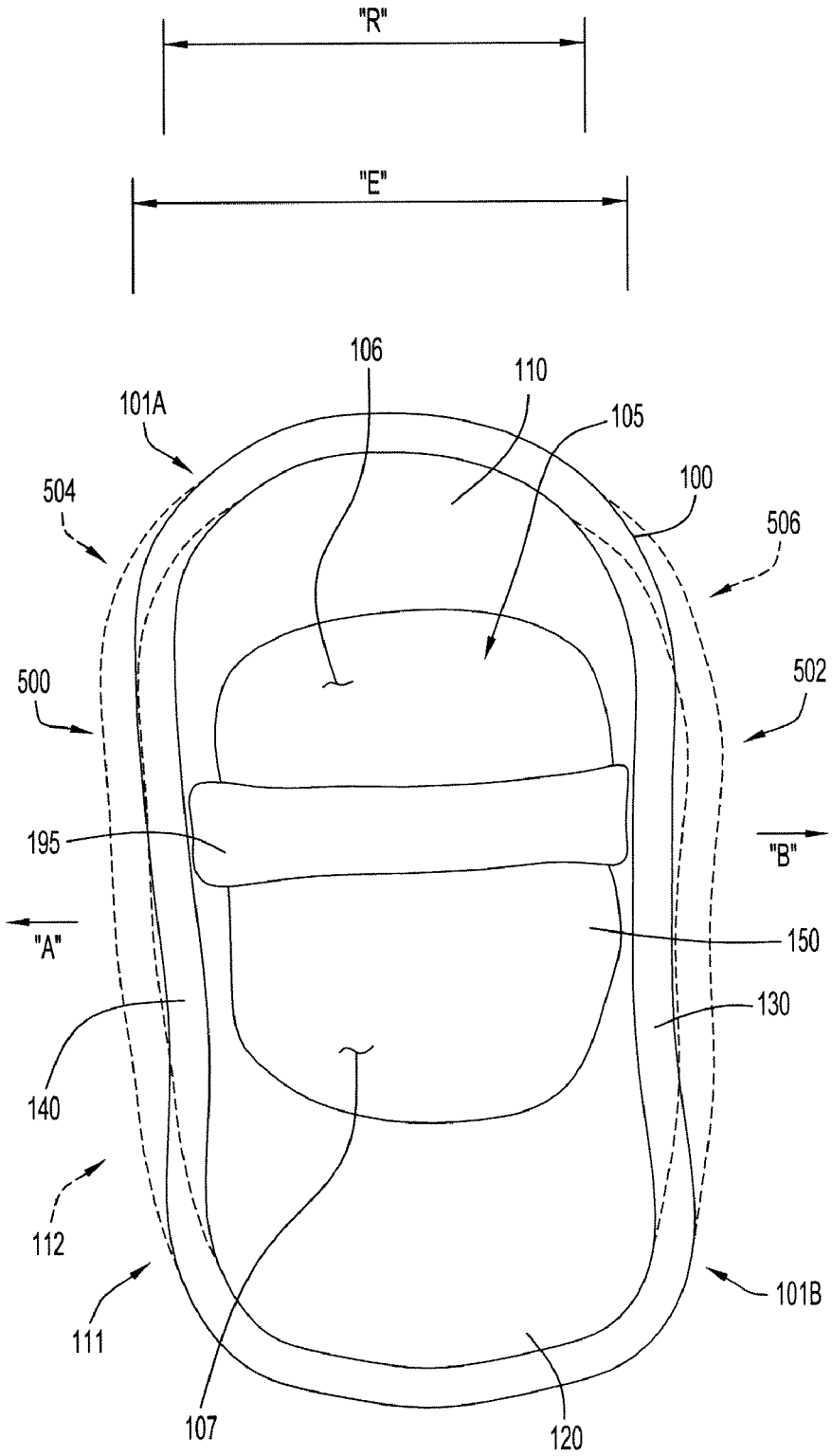
FIG. 5 illustrates a top view of an embodiment of the tub illustrated in FIG. 1.
Figure 6:
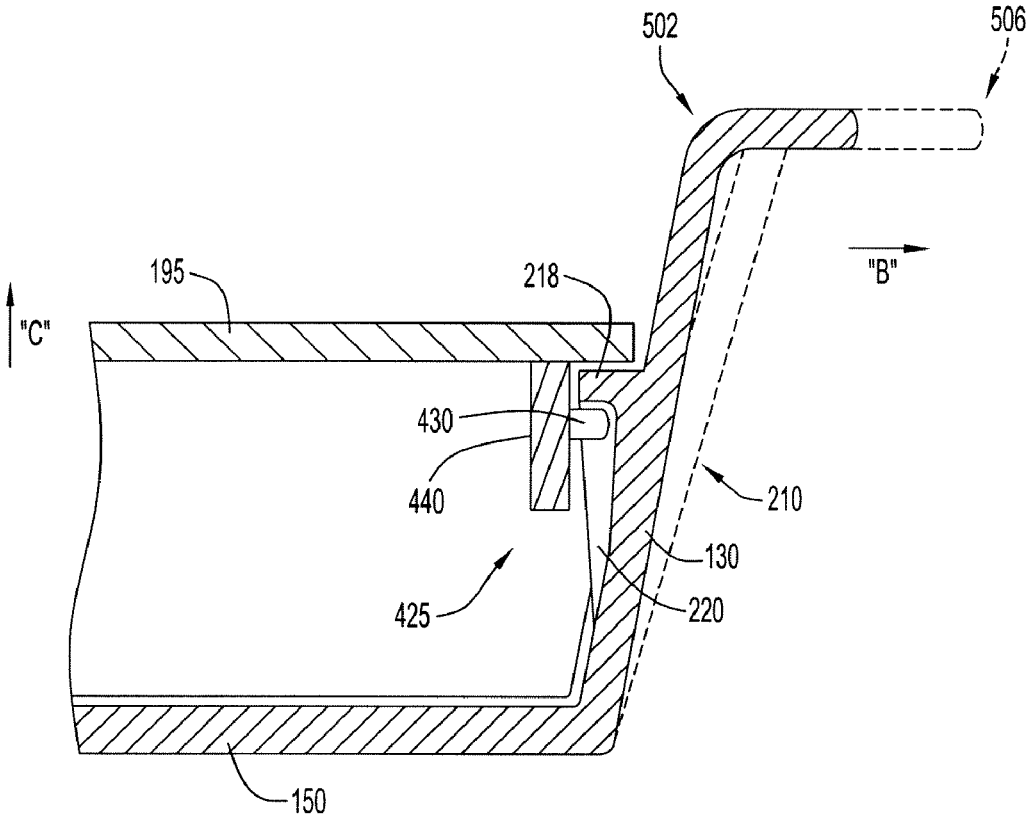
FIGS. 6 and 7 illustrate partial cross-sectional views of a portion of a tub and a portion of a support member in a coupled configuration and in a decoupled configuration, respectively.
Figure 7:
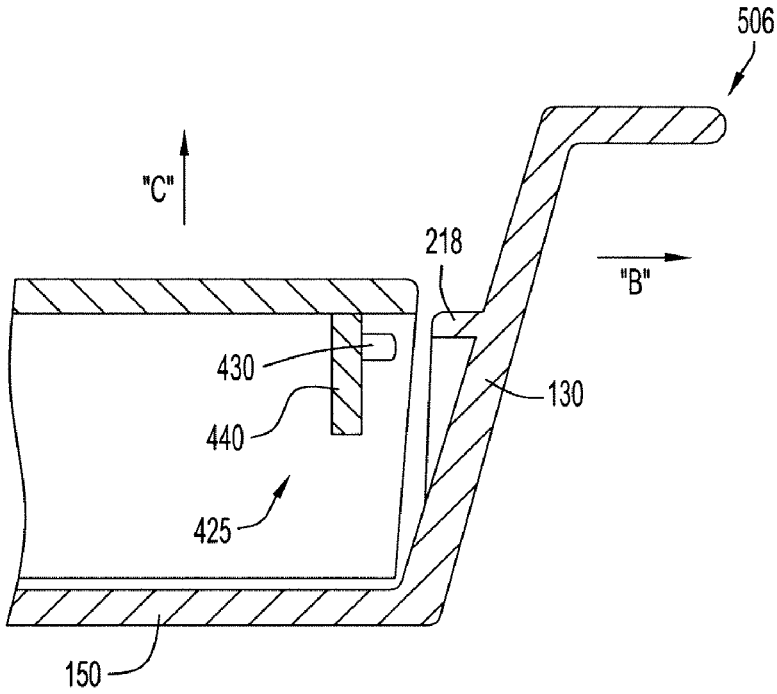

Referring to FIGS. 5-7, an exemplary method of removing the insert 195 from the tub body 100 is illustrated. FIG. 5 illustrates a top view of the tub body 100 and as shown, the tub body 100 includes backrests 110 and 120, side portions 130 and 140, and bottom portion 150. The insert 195 is placed in the receptacle 105 and forms two areas 106 and 107 with ends 101A and 101B, respectively. Instead of the receptacle 105 extending the length of the tub body 100, two smaller receiving areas or receptacles 106 and 107 are defined by the body 100 and insert 195. A child can be positioned in receptacle 106 with the child resting against the backrest 110. Alternatively, a child can be positioned in receptacle 107 with the child resting against the backrest 120. The insert 195 is coupled to the body 100 by coupling portions 405 and 425 on the insert 195 and mounting portions or mounting mechanisms 210 and 215 on the body 100. In this embodiment, the tub body 100 and the insert 195 are each formed as molded plastic objects.

In this embodiment, the tub body 100 is formed of a resilient and deformable material, such as molded plastic, that has an initial rest shape or configuration 111. Configuration 111 can be referred to as a mountable configuration. The side portions 130 and 140 of body 100 are sufficiently flexible such that they can be moved outwardly, thereby changing the shape or configuration of the tub body 100. As shown in FIG. 5, side portion 140 can be moved along the direction of arrow "A" from a rest position 500 to an extended position 504 (shown in dashed lines). Similarly, side portion 130 can be moved along the direction of arrow "B" from a rest position 502 to an extended position 506 (shown in dashed lines). A user can move side portion 140 along the direction of arrow "A" and side portion 130 along the direction of arrow "B" by grasping each of the side portions 130 and 140 and applying a force to each in the opposite outward directions (such as by pushing or pulling).

The side portions 130 and 140 in their rest or initial positions 502 and 500, respectively, correspond to the rest or locking configuration 111 of the tub body 100. The side portions 130 and 140 in their extended or expanded positions 506 and 504, respectively, correspond to the extended or unlocking configuration 112 of the tub body 100. Configuration 112 can be referred to as a releasable configuration as well. Referring to FIG. 5, in configuration 111, the distance between the mounting portions 210 and 215 of tub body 100 is shown as the dimension "R." When the side portions 130 and 140 are moved outwardly, the distance between the mounting portions 210 and 215 of tub body 100 is shown as the dimension "E." In alternative embodiments, a user can move other parts of the tub body 100 in addition to or in lieu of the side wall portions 130 and 140 to change the configuration of the tub body 100.

Referring to FIG. 6, a cross-sectional view of a portion of the insert 195 and the tub body 100 is illustrated. In FIG. 6, the insert member 195 is illustrated as being coupled to the tub body 100, and in particular, to the side portion 130. The insert member 195 includes a coupling portion 425 that is engaged with the mounting portion 210 of the side portion 130. The coupling portion 425 includes the projection support 440 from which projection 430 extends. The projection 430 is configured to engage the recess 220 that is formed in the mounting portion 210. When the projection 430 is engaged with the recess 220, movement of the insert 195 along the direction of arrow "C" is limited and prevented. Accordingly, the insert 195 remains coupled to the body 100 proximate to the bottom 150 and can be engaged by the body of an infant or child in the tub 10.

When the side portion 130 is in its rest position 502, the wall 218 at the upper end of recess 220 limits movement of the projection 430 and as a result, the insert 195. When a user, such as a parent or caregiver, wants to remove the insert 195 from the tub 10, the user applies a force to the side portion 130 outwardly along the direction of arrow "B," thereby moving the side portion 130 from its rest position 502 to its extended or unlocking position 506 (shown in dashed lines in FIG. 6). As shown in FIG. 7, as the side portion 130 moves, the wall 218 also moves. When the wall 218 moves a sufficient distance, the wall 218 no longer contacts the projection 430, thereby allowing the projection 430 to move along the direction of arrow "C" away from the bottom 150 and the mounting portion 210. At this point, the insert 195 can be removed from the tub body 100. In one embodiment, the insert 195 pops out of engagement from the tub body 100 when it is released.

Thus, in the embodiment illustrated in FIGS. 5-7, to decouple the insert or positioning member 195 from the tub body 100, the distance between the mounting portions 210 and 215 on the tub body 100 has to be greater than the distance between the tips of the projections 410 and 430 of the insert 195 (see dimension "P" in FIG. 4). The side portions 130 and 140 can be moved substantially simultaneously or at different times. In other words, a force can be applied to side portion 130 and not to side portion 140. Alternatively, a force can be applied to side portion 140 and not to side portion 130. Moreover, outwardly directed forces can be applied to side portions 130 and 140 at the same time.

Figure 7A:
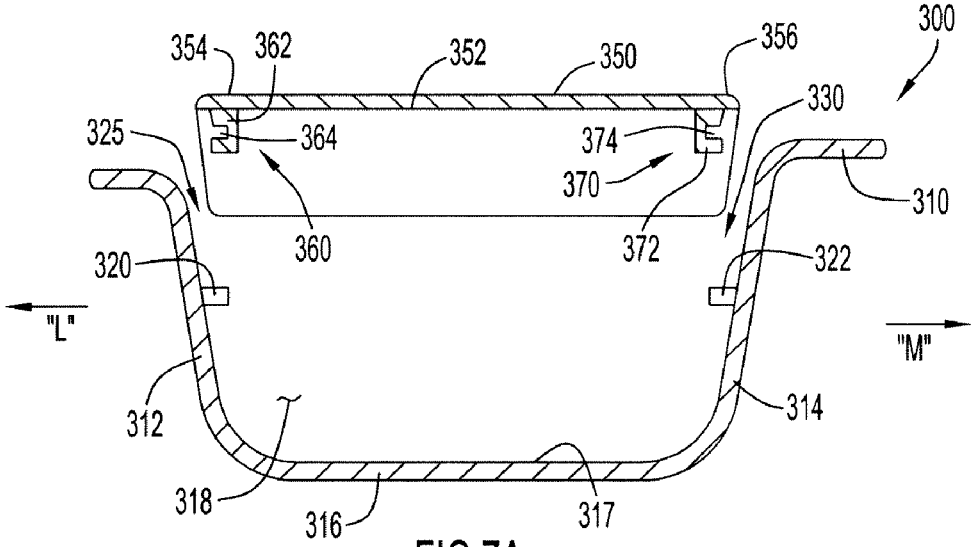
FIG. 7A illustrates a partial cross-sectional view of an alternative embodiment of a tub assembly according to the present invention.

Referring to FIG. 7A, an alternative embodiment of a tub assembly according to the present invention is illustrated. In this embodiment, the tub assembly 300 includes a tub body 310 with portions 312 and 314 and a bottom portion 316 with a bottom surface 317. The tub body 310 defines a receptacle or receiving area 318 in which an infant can be placed. Extending from portion 312 is a projection 320 which forms a mounting portion or mechanism 325 on the tub body 310. Similarly, extending from portion 314 is a projection 322 which forms a mounting portion or mechanism 330 on the tub body 310. In one embodiment, the projections 320 and 322 are integrally formed with the tub body 310. In addition, portions 312 and 314 may be side portions or side wall portions.

Referring to FIG. 7A, an insert or positioning member 350 can be used with the tub body 310 to define multiple receptacles or receiving areas in which an infant may be disposed. In this embodiment, the insert 350 includes a body or engaging portion 352 that has opposite ends 354 and 356. Proximate to ends 354 and 356 are coupling portions 360 and 370, respectively. Coupling portion 360 includes a support portion 362 that is coupled to body 352 and that includes a recess 364 that is configured to receive projection 320. Similarly, coupling portion 370 includes a support portion 372 that is coupled to body 352 and that includes a recess 374 that is configured to receive projection 322. When the projections 320 and 322 are engaged with the recesses 364 and 374, respectively, the insert 350 is coupled to the tub body 310. When portions 312 and 314 are moved outwardly along the direction of arrows "L" and "M," the projections 320 and 322 disengage from the recesses 364 and 374, thereby unlocking and releasing the insert 350 from the tub body 310.

Figure 8:
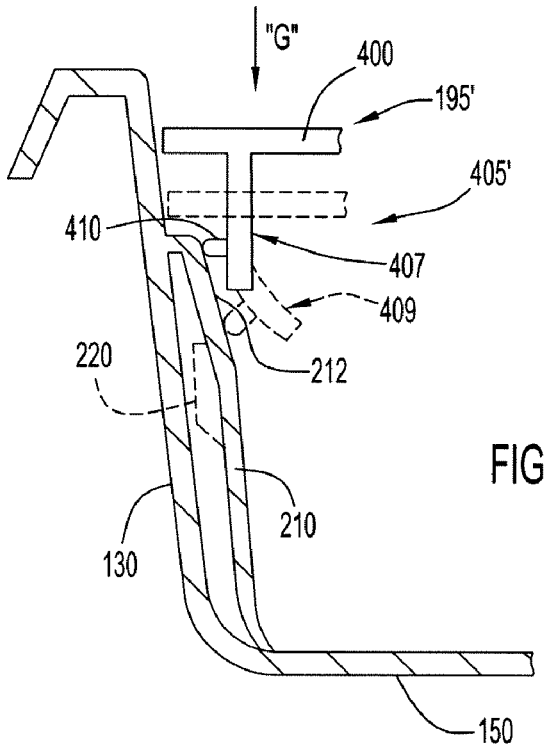
FIG. 8 illustrates a partial cross-sectional view of an alternative embodiment of a portion of a tub and a portion of a support member in a decoupled configuration according to the present invention.
Figure 9:
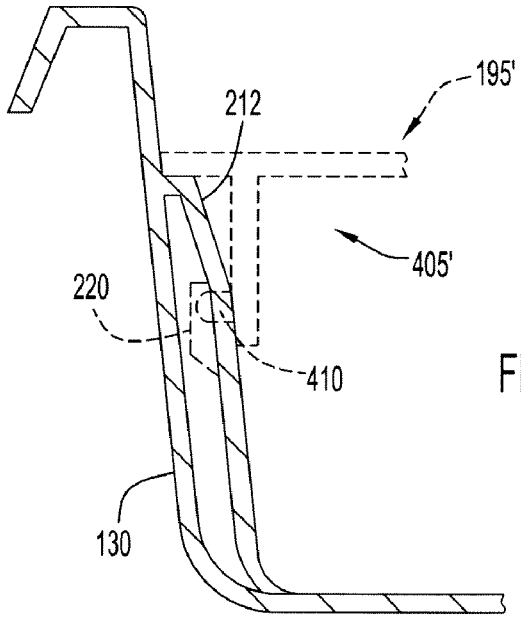
FIG. 9 illustrates a partial cross-sectional view of the tub and the support member illustrated in FIG. 8 in a coupled configuration.
Figure 10:
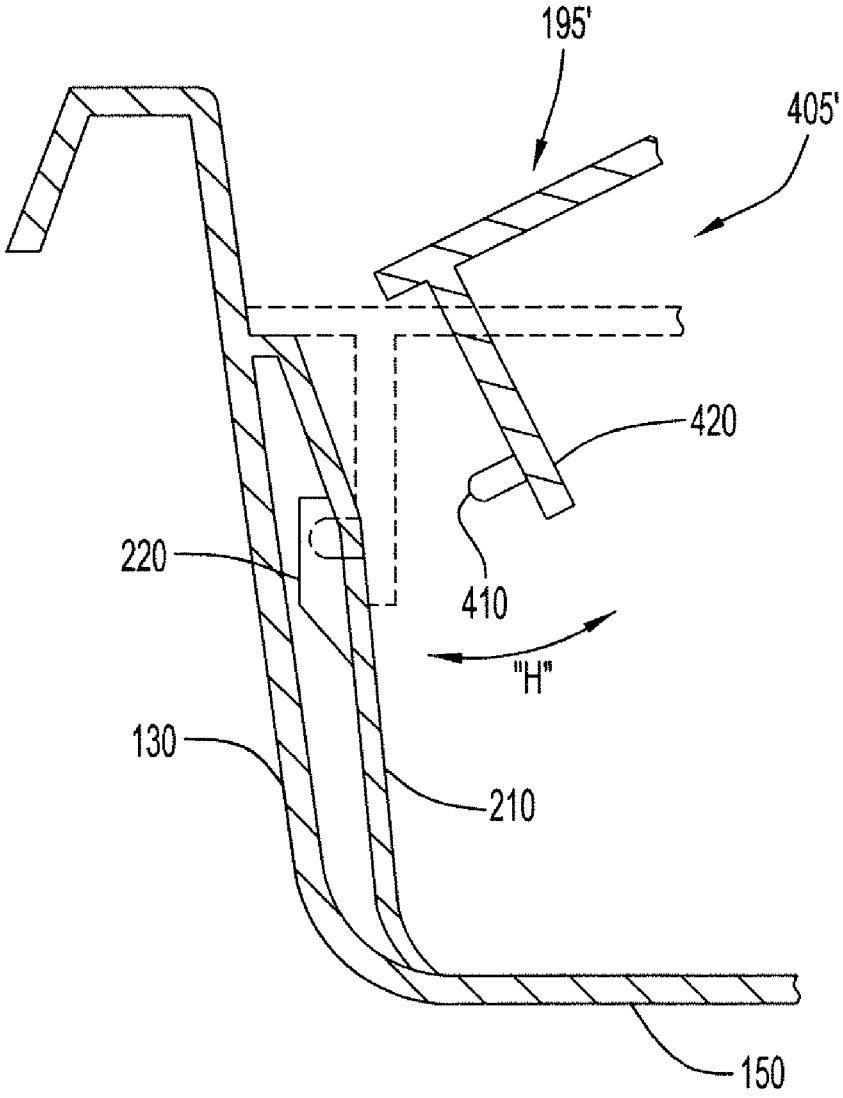
FIG. 10 illustrates a partial cross-sectional view of the tub and the support member illustrated in FIG. 8 in a spaced apart configuration.

Referring to FIGS. 8-10, a portion of an alternative embodiment of a tub according to the present invention is illustrated. In this embodiment, the tub includes the same components as tub 10 described above (such as with side portion 130 and bottom 150) and similar elements have similar reference numerals. However, in this embodiment, the insert member 195' is formed of a flexible material that allows for the coupling portions of the insert member 195' to move relative to the body 400 of the insert member 195'. In this variation, the insert 195' is adjustable as opposed to the tub 10. In other words, while the insert 195' is coupled to the tub body 100 using coupling portions and mounting portions similar to those described above, the insert 195' can be decoupled by deforming the insert 195' and not by deforming the tub body 100.

As shown in FIG. 8, the coupling portion 405' of body 400 of insert 195' has an initial or non-deformed shape 407 and can move to a deformed shape 409 relative to the remainder of the insert 195'. The flexibility of body 400 allows portions of the insert 195' to be deformed by external forces into deformed shape 409. The application of force, such as by squeezing, to the middle portion of the body 400 causes the opposite coupling portions (only coupling portion 405' being shown in FIG. 8) to retract inwardly.

Referring to FIG. 8, as the insert 195' is moved along the direction of arrow "G" relative to tub body 100, the shape of the insert 195' changes as the projection 410 engages the mounting portion 210 and in particular, the inclined surface 212. Once the projection 410 clears the upper portion of mounting portion 210, the projection 410 engages recess 220 as shown in FIG. 9. The other end of the insert 195' can be manipulated in a similar manner to couple the insert 195' to the mounting portion 215 of the tub body 100.

In the various embodiments disclosed herein, the inserts 195 and 195' can be coupled to a tub 10 via different methods. In one method, the insert 195' is forced onto the mounting portion 210 as shown in FIG. 8 and the coupling portions 405' and 425' deform until the projections 410 and 430 engage recesses 220 and 225. In another method (shown in FIG. 10), the insert 195' is deformed by a parent squeezing the insert 195' to move inwardly the coupling portions 405' and 425' before placing the insert 195' in its coupled position on the tub body 100. In both methods, the insert 195' flexes back to its rest position and the projections 410 and 430 extend outwardly and engage mounting portions 210 and 215. As shown in FIG. 10, the coupling portion 405' can be moved along the direction of arrow "H" to engage and disengage projection 410 from the recess 220. To decouple the insert 195', coupling portion 405 and 425 are moved relative to the mounting portions 210 and 215 and the insert 195' can then be removed from the tub body.

FIGS. 11-15 illustrate an alternative embodiment of a tub according to the present invention. In this embodiment, insert or positioning member 705 is shown coupled to tub body 702 of tub 700. The insert member 705 includes engagement portions 717 and 719 that collectively form a substantially inverted U-shape. The insert member 705 can be formed of a molded plastic material that when engagement portions 717 and 719 are squeezed toward each other, the biasing characteristic of the insert member 705 causes the engagement portions 717 and 719 to move away from each other.

Figure 11:
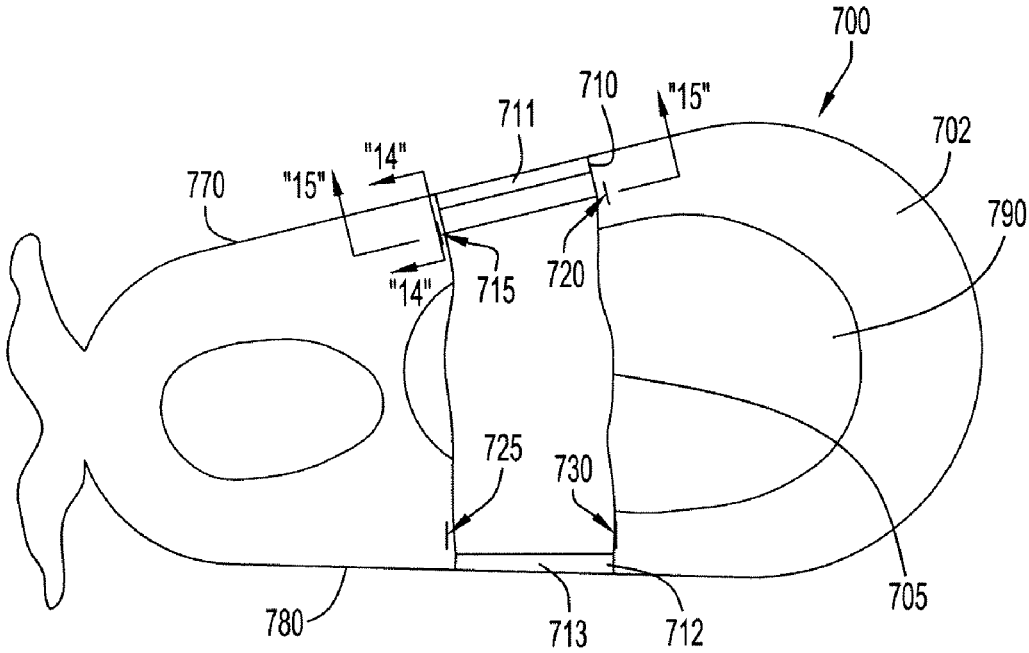
FIG. 11 illustrates a top view of an alternative embodiment of a tub according to the present invention.

As shown in FIG. 11, the tub body 702 includes a mounting portion 710 adjacent to side portion 770 and an opposite mounting portion 712 adjacent to side portion 780. Mounting portions 710 and 712 include mounting surfaces 711 and 713, respectively. Mounting portion 710 includes slots 715 and 720 formed proximate to tub bottom 790. Tub body 702 also includes slots 725 and 730 formed proximate to tub bottom 790 (see FIGS. 11 and 13).

Figure 12:
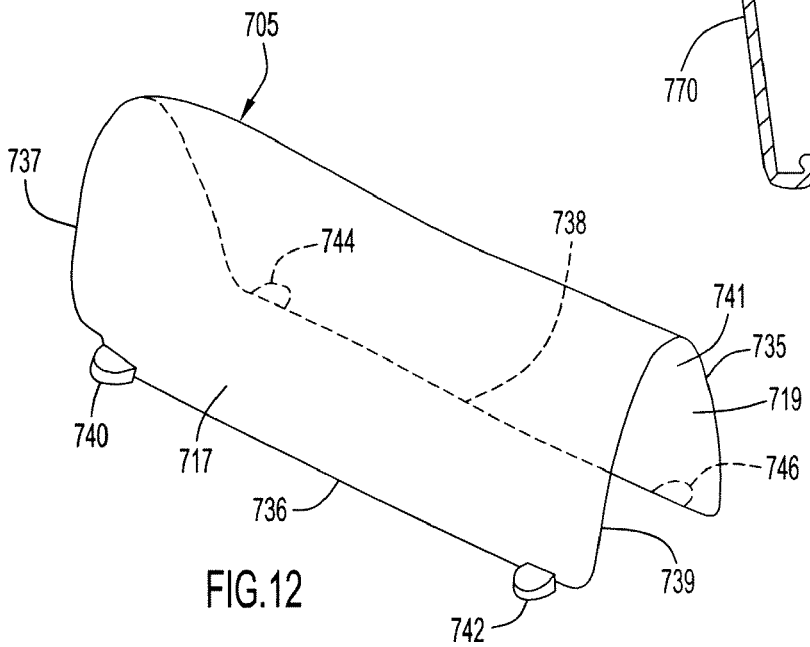
FIG. 12 illustrates a perspective view of an embodiment of a support member that can be used with the tub illustrated in FIG. 11.

FIG. 12 illustrates a perspective view of insert 705. Insert 705 includes a body portion 735 defined by edges 736, 737, 738, and 739 and tabs or projections 740, 742, 744 and 746 that extend outwardly from the body portion 735 as shown. The body portion 735 is formed from a flexible material that allows the edges 736 and 738 of the body portion 735 to be moved toward each other. This movement brings tabs 740 and 742 toward tabs 744 and 746.

Figure 13:
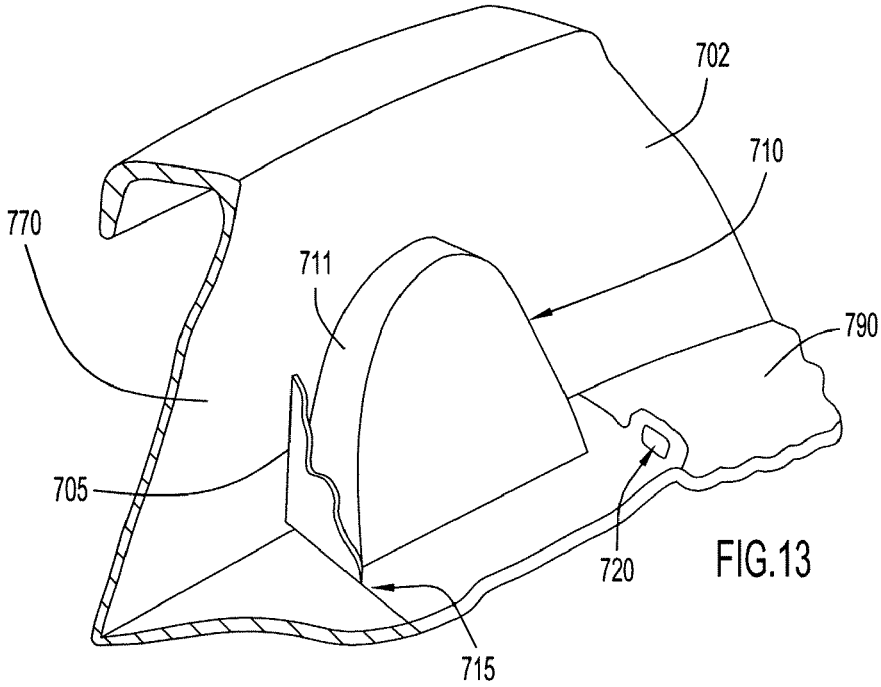
FIG. 13 illustrates a partial cross-sectional view of a portion of the tub illustrated in FIG. 11.
Figure 14:
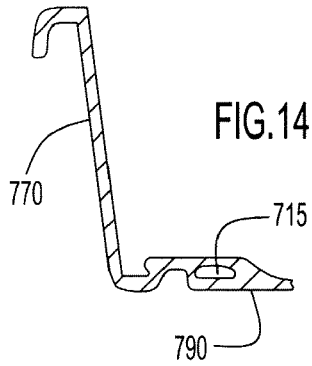
FIG. 14 illustrates a partial cross-sectional view of a portion of the tub illustrated in FIG. 11.

Referring to FIGS. 13 and 14, slot 715 is formed spaced apart from side portion 770. Each of the other slots 720, 725, and 730 is formed spaced apart from its corresponding or proximate side portion. The distance between the tabs 740, 742, 744, and 746 corresponds with the distance between the slots 715, 720, 725, and 730.

The insert 705 is placed into its locked position on tub body 705 by placing edges 737 and 735 on mounting surfaces 711 and 713, respectively. The insert 705 is then squeezed until tabs 740 and 744 are positioned between and aligned with slots 715 and 720 and tabs 742 and 746 are positioned between and aligned with slots 725 and 730, respectively. The insert 705 is then released so that it flexes outwardly and forces tabs 740, 744, 742, and 746 into aligned slots 715, 720, 725, and 730 respectively. The edges 737 and 735 contact mounting surfaces 711 and 713, respectively, and edges 736 and 738 contact the tub bottom 790. FIG. 11 illustrates a top view of the insert 705 coupled to the tub body 702. In this position, the insert 705 is engaged with slots 715, 720, 725, and 730. The insert 705 can be unlocked and removed from mounting portions 710 and 712 by squeezing the insert 705 until tabs 740, 742, 744, and 746 are removed or disengaged from slots 715, 720, 725, and 730 respectively.

Figure 15:
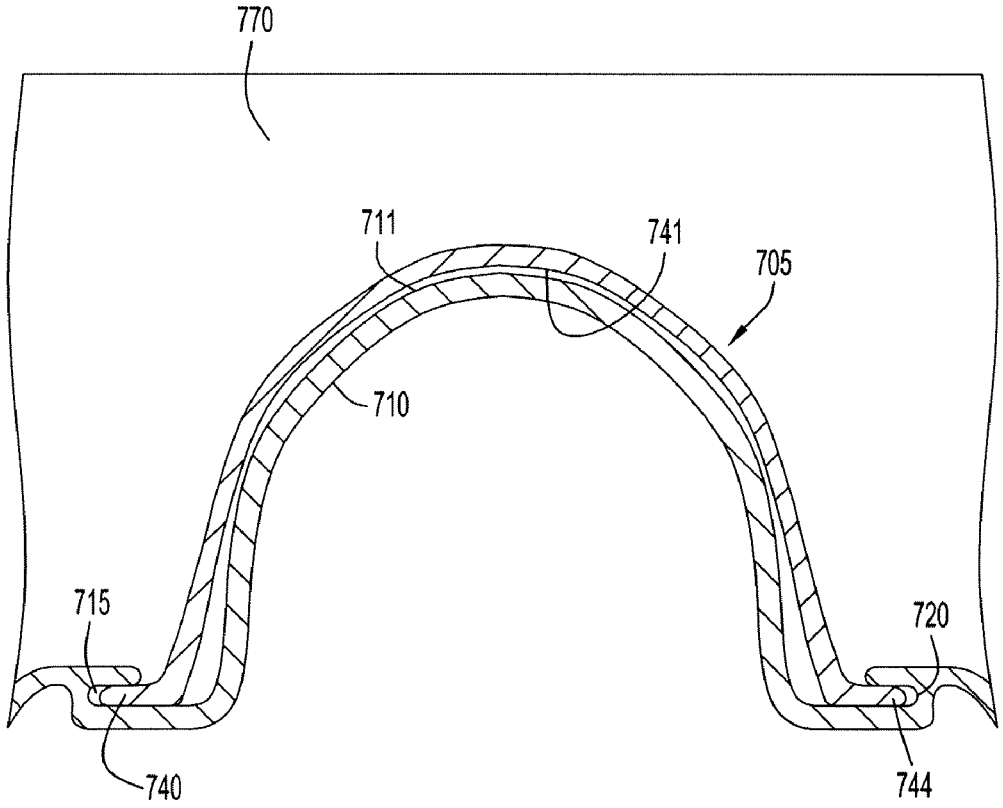
FIG. 15 illustrates a cross-sectional view of a portion of the tub and the support member illustrated in FIG. 11.

FIG. 15 illustrates a cross-sectional view of the insert 705 disposed proximate to mounting portion 710. As shown, the insert 705 can be positioned such that tabs 740 and 744 engage slots 715 and 720, respectively. The inner surface 741 of body 705 is disposed proximate to surface 711 of the mounting portion 710, which is formed proximate to side portion 770.

Figure 16:
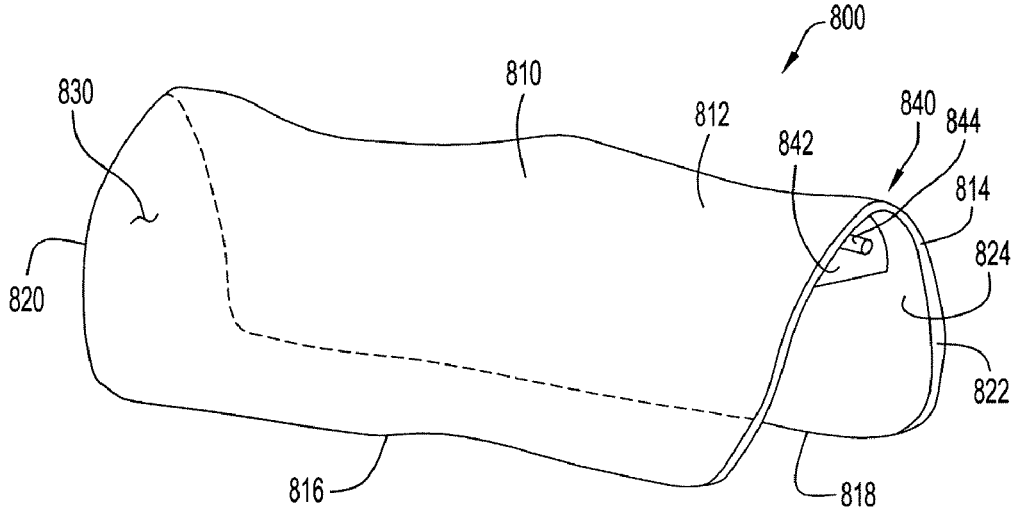
FIG. 16 illustrates a perspective view of an alternative embodiment of a support member according to the present invention.

Referring to FIG. 16, an alternative embodiment of a support member according to the present invention is illustrated. In this embodiment, the support member 800 includes a body or body portion 810 that has two engagement portions 812 and 814 that are engagement surfaces for an infant. Each of the engagement portions 812 and 814 have lower or bottom edges 816 and 818. The body portion 810 has opposite ends 820 and 822 and an inner surface 824 that defines a channel 830 therethrough. In this embodiment, the support member 800 includes a single coupling portion 840, which is disposed proximate to end 822. The coupling portion 840 includes a support or plate 842 from which a projection 844 extends. Notably, there is no coupling portion proximate to end 820. In use, friction between end 820 and an inner surface of a tub body is used for end 820 of the support member 800 in lieu of another coupling portion.

Figure 17:
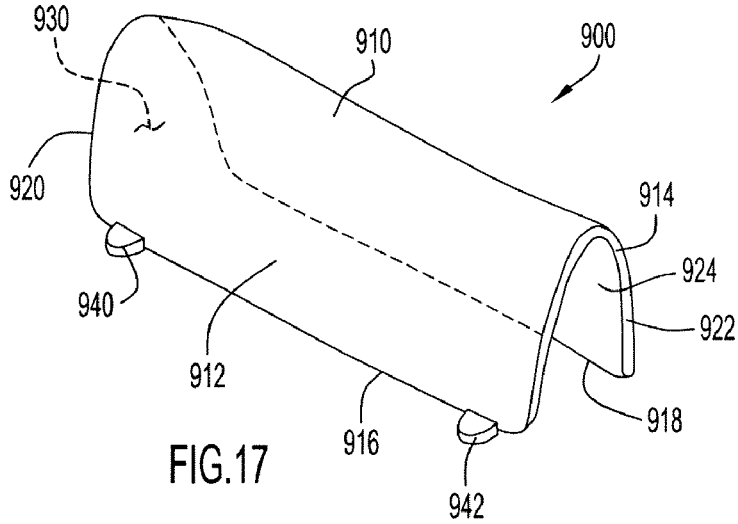
FIG. 17 illustrates a perspective view of an alternative embodiment of a support member according to the present invention.

Referring to FIG. 17, an alternative embodiment of a support member according to the present invention is illustrated. In this embodiment, the support member 900 includes a body 910 with engagement portions 912 and 914 having lower ends or edges 916 and 918. The body 910 has opposite ends 920 and 922 and an inner surface 924 that defines a channel 930. In this embodiment, the body 910 includes projections 940 and 942 extending from engagement portion 912. However, the body 910 does not include any corresponding projections extending from the other side of the body 910 or from engagement portion 914. The lower end 918 of portion 914 can be placed into engagement with a groove or ridge formed in a tub body to otherwise provide a force to maintain projections 940 and 942 engaged with slots or recesses formed in the tub body.

Figure 18:
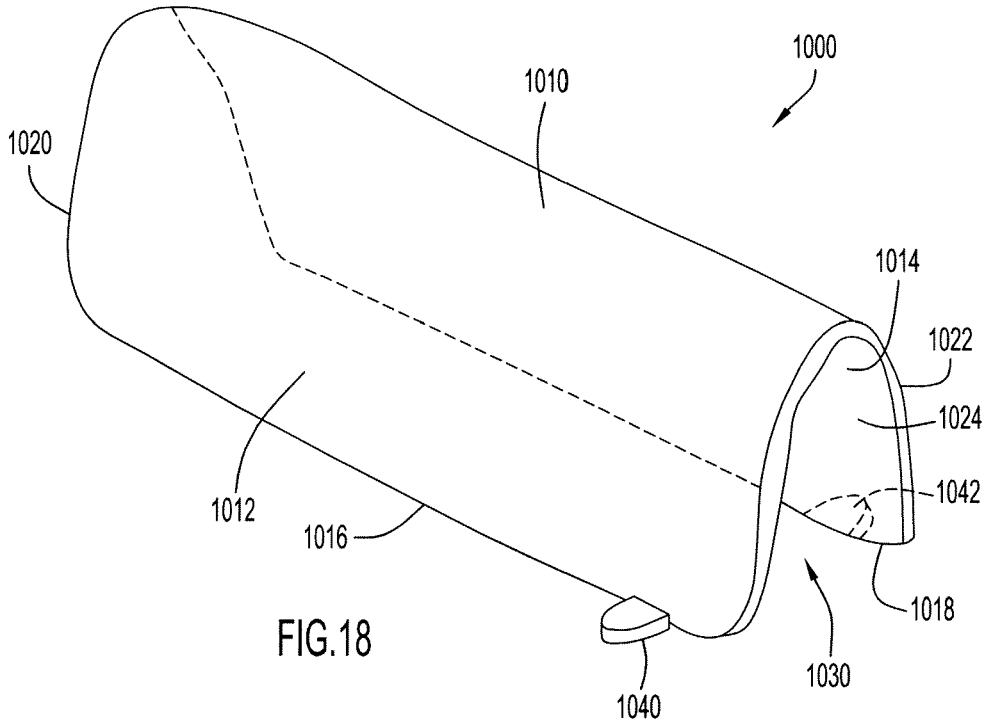
FIG. 18 illustrates a perspective view of an alternative embodiment of a support member according to the present invention.

Referring to FIG. 18, an alternative embodiment of a support member according to the present invention is illustrated. In this embodiment, the support member 1000 includes a body 1010 with engagement portions 1012 and 1014 having lower ends or edges 1016 and 1018. The body 1010 has opposite ends 1020 and 1022 and an inner surface 1024 that defines a channel 1030. In this embodiment, the body 1010 includes projections 1040 and 1042 extending from portions 1012 and 1014 proximate to end 1022. However, the body 1010 does not include any corresponding projections extending outwardly proximate to opposite end 1020 of the body 1010.

In alternative embodiments, the engagement between the insert and the tub body may be between the insert and only the bottom of the tub. In addition, the engagement structures (e.g., projections, tabs, slots or recesses) may be reversed so that slots are formed on the insert and tabs or projections are positioned on the tub body. Moreover, the quantity of projections and/or coupling portions provided on the support member can vary in different embodiments.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. A bath tub assembly comprising:

a tub, the tub including a body defining a receptacle, the body including a bottom surface, a first end portion, a second end portion, a first side portion, and a second side portion, the body including at least one mounting portion; and an insert member, the insert member releasably coupled to the body, the insert member including at least one coupling portion engaging the at least one mounting portion, the insert member coupled to the body of the tub when the at least one coupling portion engages the at least one mounting portion, and the insert member having a substantially inverted U-shape configuration including an upper curved side and a lower curved side that opposes the upper curved side, wherein the upper and lower curved sides extend to a lower end of the insert member that includes distal edges separated from each other by a distance;

wherein coupling of the insert member to the body results in a partition of the receptacle by the insert member extending between the first and second side portions with the entire insert member being distant from the first and second end portions.

2. The bath tub assembly of claim 1, wherein the at least one mounting portion comprises a mounting surface disposed along at least one of the first and second side portions that is curved in an inverted U-shaped configuration that generally conforms with a curvature of the lower curved side of the insert member so as to engage with portions of the lower curved side of the insert member when the at least one coupling portion engages the at least one mounting portion.

3. The bath tub assembly of claim 2, wherein the coupling portion of the insert member comprises a projection support disposed adjacent a portion of the lower curved side, and the at least one mounting portion further comprises an inclined surface aligned transverse to the mounting surface, the inclined surface including a recess that is positioned to receive a projection of the projection support when the at least one coupling portion engages the at least one mounting portion.

4. The bath tub assembly of claim 2, wherein the at least one mounting portion including the mounting surface is disposed adjacent the bottom surface of the tub body.

5. The bath tub assembly of claim 1, wherein the at least one mounting portion further comprises at least one slot disposed proximate the bottom surface of the tub body, and the at least one coupling portion comprises at least one tab extending from the upper curved side proximate a portion of at least one of the distal edges of the insert member, the at least one tab being configured to align and engage with the at least one slot when the at least one coupling portion engages the at least one mounting portion.

6. The bath tub assembly of claim 1, wherein the at least one mounting portion includes a recess formed in the first side portion, and the at least one coupling portion includes a projection that is configured to engage the recess of the first side portion.

7. The bath tub assembly of claim 1, wherein the at least one mounting portion is located on the first side portion proximate to the bottom surface.

8. The bath tub assembly of claim 1, wherein the tub body is formed of a deformable material so that application of outward forces to the first side portion and to the second side portion moves the first side portion and the second side portion away from each other, thereby decoupling the insert member from the body of the tub.

9. The bath tub assembly of claim 1, wherein the first side portion of the tub includes a first mounting portion, the second side portion of the tub includes a second mounting portion, and the insert member includes a first coupling portion and a second coupling portion, the first coupling portion being configured to engage the first mounting portion and the second coupling portion being configured to engage the second mounting portion.

10. The bath tub assembly of claim 9, wherein the insert member has a first end and a second end opposite the first end, the upper and lower curved sides extend between the first and second ends, and the upper curved side comprises an engaging portion that is configured to be engaged by an infant in the receptacle, the first coupling portion is disposed proximate to the first end of the insert member, and the second coupling portion is disposed proximate to the second end of the insert member.

11. A bath tub assembly comprising:

a tub, the tub including a body defining a receptacle, the body including a bottom surface, a first end portion, a second end portion, a first side portion, and a second side portion, the body including at least one mounting portion; and an insert member, the insert member releasably coupled to the body, the insert member including at least one coupling portion engaging the at least one mounting portion, the insert member coupled to the body of the tub when the at least one coupling portion engages the at least one mounting portion, and the insert member having a substantially inverted U-shape configuration including an upper curved side and a lower curved side that opposes the upper curved side, wherein the upper and lower curved sides extend to a lower end of the insert member that includes distal edges separated from each other by a distance;

wherein coupling of the insert member to the body results in a partition of the receptacle by the insert member extending between the first and second side portions and being distant from the first and second end portions such that the receptacle includes two open and uncovered compartments defined within the body on either side of the insert member.

12. The bath tub assembly of claim 11, wherein the at least one mounting portion includes a recess formed in the first side portion, and the at least one coupling portion includes a projection that is configured to engage the recess of the first side portion.

13. The bath tub assembly of claim 11, wherein the at least one mounting portion is located on the first side portion proximate to the bottom surface.

14. The bath tub assembly of claim 11, wherein the tub body is formed of a deformable material so that application of outward forces to the first side portion and to the second side portion moves the first side portion and the second side portion away from each other, thereby decoupling the insert member from the body of the tub.

15. An infant tub, comprising:

a body, the body defining a receptacle in which an infant can be disposed in a first position and in a second position, the body including a first end portion and a second end portion, and the body further including a first side wall portion and a second side wall portion, the second side wall portion being movable relative to the first side wall portion; and a positioning member, the positioning member being releasably coupleable to the body, the body being deformable and movable between a first configuration in which the positioning member can be coupled to the first side wall portion of the body and the second side wall portion of the body and a second configuration in which the positioning member can be decoupled from the first side wall portion of the body and the second side wall portion of the body, the positioning member having a substantially inverted U-shape configuration including an upper curved side and a lower curved side that opposes the upper curved side, wherein the upper and lower curved sides extend to a lower end of the positioning member that includes distal edges separated from each other by a distance;

wherein coupling of the positioning member to the body results in a partition of the receptacle by the positioning member extending between the first and second side wall portions with the entire positioning member being distant from the first and second end portions.

16. The infant tub of claim 15, wherein the second side wall portion is disposed opposite to the first side wall portion, a first mounting portion is formed on the first side wall portion, and a second mounting portion is formed on the second side wall portion, the positioning member being configured to engage the first mounting portion and the second mounting portion to couple the positioning member to the body.

17. The infant tub of claim 16, wherein the positioning member includes a first coupling portion and a second coupling portion, the first coupling portion is configured to engage the first mounting portion, and the second coupling portion is configured to engage the second mounting portion.

18. The infant tub of claim 17, wherein the first mounting portion of the body includes one of a recess and a projection and the first coupling portion of the positioning member includes the other of the recess and the projection.

19. The infant tub of claim 17, wherein the first mounting portion and the second mounting portion are closer to each other when the body is in its first configuration than when the body is in its second configuration.

20. An infant tub, comprising:

a body, the body defining a receptacle in which an infant can be disposed in a first position and in a second position, the body including a first end portion and a second end portion, and the body further including a first side wall portion and a second side wall portion, the second side wall portion being movable relative to the first side wall portion; and a positioning member, the positioning member being releasably coupleable to the body, the body being deformable and movable between a first configuration in which the positioning member can be coupled to the first side wall portion of the body and the second side wall portion of the body and a second configuration in which the positioning member can be decoupled from the first side wall portion of the body and the second side wall portion of the body, the positioning member having a substantially inverted U-shape configuration including an upper curved side and a lower curved side that opposes the upper curved side, wherein the upper and lower curved sides extend to a lower end of the positioning member that includes distal edges separated from each other by a distance;

wherein coupling of the positioning member to the body results in a partition of the receptacle by the positioning member extending between the first and second side wall portions and being distant from the first and second end portions such that the receptacle includes two open and uncovered compartments defined within the body on either side of the positioning member.

21. The infant tub of claim 20, wherein the second side wall portion is disposed opposite to the first side wall portion, a first mounting portion is formed on the first side wall portion, and a second mounting portion is formed on the second side wall portion, the positioning member being configured to engage the first mounting portion and the second mounting portion to couple the positioning member to the body.

22. The infant tub of claim 21, wherein the positioning member includes a first coupling portion and a second coupling portion, the first coupling portion is configured to engage the first mounting portion, and the second coupling portion is configured to engage the second mounting portion.

* * * * *